US006408817B2

(12) United States Patent
Torii et al.

(10) Patent No.: US 6,408,817 B2
(45) Date of Patent: Jun. 25, 2002

(54) THROTTLE BODY FOR AN INTERNAL COMBUSTION ENGINE AND ITS MANUFACTURING METHOD AND A THROTTLE APPARATUS USING THE SAME

(75) Inventors: Katsuya Torii; Yuichiro Miura, both of Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/781,193

(22) Filed: Feb. 13, 2001

(30) Foreign Application Priority Data

Feb. 16, 2000 (JP) ..... 2000-37954
Mar. 29, 2000 (JP) ..... 2000-90651
Oct. 31, 2000 (JP) ..... 2000-333043

(51) Int. Cl.[7] ..... F02D 9/08
(52) U.S. Cl. ..... 123/337; 123/556; 123/142.5 R; 251/305; 29/888.4
(58) Field of Search ..... 123/142.5 R, 337, 123/556, 41.31, 41.4; 29/888.4; 251/305

(56) References Cited

U.S. PATENT DOCUMENTS 3,942,495 A * 3/1976 Kobayashi et al. ... 123/142.5 R
5,704,335 A * 1/1998 Akutagawa et al. ..... 123/337
5,819,712 A * 10/1998 Cox ..... 123/142.5 R

FOREIGN PATENT DOCUMENTS

| | | |
|---|---|---|
| GB | 2 064 658 | 6/1981 |
| JP | 56-96142 | 8/1981 |
| JP | 61-73056 | 5/1986 |
| JP | 2-91431 | 3/1990 |
| JP | 3-78537 | 4/1991 |
| JP | 4-119352 | 10/1992 |
| JP | 8-135506 | 5/1996 |

* cited by examiner

*Primary Examiner*—Erick Solis
(74) *Attorney, Agent, or Firm*—Nixon & Vanderhye P.C.

(57) ABSTRACT

A hot water conduit is formed between an inner cylinder and an outer cylinder. A gasket seals an annular opening of the hot water conduit facing to a surge tank. Hot water is supplied into the conduit from an engine cooling water passage. Heat of the hot water is effectively transferred to the entire vicinity or surrounding of a throttle valve, thereby effectively avoiding icing phenomenon of the throttle apparatus.

12 Claims, 7 Drawing Sheets

THROTTLE BODY FOR AN INTERNAL COMBUSTION ENGINE AND ITS MANUFACTURING METHOD AND A THROTTLE APPARATUS USING THE SAME

BACKGROUND OF THE INVENTION

The present invention relates to a throttle body for an internal combustion engine forming part of an air passage of an internal combustion engine (hereinafter, referred to as engine) and its manufacturing method.

From recent requirements of weight reduction as well as cost reduction, some of conventional engines install a throttle body whose housing is made of a resin.

When the engine is operated in cold districts, a throttle body controlling an intake air amount of the engine is often subjected to icing phenomenon according to which a valve member (i.e., a throttle valve) is frozen together with an inside wall of an intake passage formed in the throttle body under low-temperature conditions.

To prevent the icing phenomenon of the throttle body, it is conventionally known to provide a hot water conduit supplying hot engine cooling water to the vicinity or surrounding of a throttle valve.

FIG. 6 shows a conventional throttle apparatus which discloses a hot water conduit directly formed in the throttle body to guide the hot engine cooling water to the vicinity or surrounding of a throttle valve.

More specifically, as shown in FIG. 6, a throttle body 1 has an intake passage 2 formed therein. A shaft 3 securely fixing a throttle valve 4 is rotatably supported in the housing 1. The throttle valve 4 adjusts an opening degree of the intake passage 2. A hot water conduit 6, which supplies hot engine cooling water, extends straight in the vicinity of the intake passage 2. An inlet pipe 7 and an outlet pipe 8 are connected to an inlet side and an outlet side of this hot water conduit 6. The housing 1 is made of an aluminum member and therefore has relatively better heat-transfer properties. Thus, when the hot engine cooling water flows in the hot water conduit 6, heat of the hot water is transferred to the throttle valve 4.

As described above, when a throttle valve body has an aluminum housing, supplying hot engine cooling water into the hot water conduit formed in the throttle body makes it possible to effectively prevent the throttle valve from icing during a vehicle running condition in cold districts.

However, changing the housing material from aluminum to a resin will cause the following problems.

The heat conductivity of a resin is lower than that of aluminum. It is now assumed that the aluminum housing of the above-described conventional throttle body is simply replaced by a resinous or resin-made housing without changing the arrangement of the hot water conduit. In this case, a sufficient amount of heat will not be transferred to the intake passage side due to low heat conductivity of a resin even if hot water is sufficiently supplied into the hot water conduit.

Unexamined Japanese patent publication 8-135506 discloses a throttle body for an engine which has a resinous or resin-made housing separable into two parts and has a hollow space in the vicinity of an intake passage for introducing hot water.

However, according to the throttle body disclosed in unexamined Japanese patent publication 8-135506, it is necessary to prepare two separate parts for the housing and also necessary to assemble these parts to accomplish the housing. Accordingly, the assembling steps will be complicate and the manufacturing cost increases correspondingly.

Furthermore, according to the throttle body equipped with the aluminum housing 1 shown in FIG. 6, hot engine cooling water is introduced into the hot water conduit 6 locally provided in the throttle body. Therefore, heat of the hot water can be transferred to a limited area of the housing closer to this hot water conduit 6. In other words, insufficient heat is transferred to an opposed side of the housing which is far from the hot water conduit 6 over the throttle valve 4. Accordingly, heat of hot water is not delivered uniformly to the entire area of the housing. This makes it difficult to ensure the anti-icing effect of supplying hot water to the vicinity of the throttle valve. Furthermore, it is necessary to cut the housing partly to form the hot water conduit 6. This will further complicate the manufacturing steps and increase the manufacturing cost.

On the other hand, according to another conventional throttle apparatus, a metallic ring surrounding the outer periphery of a throttle valve is attached to the inside wall of an intake passage of a resinous or resin-made throttle body. Hot water or comparable heating medium is supplied to this metallic ring so as to prevent the icing phenomenon.

However, forming a fluid passage of hot water between an outer wall of the metallic ring and the resinous throttle body is disadvantageous in that hot water may leak between a clearance or gap between the metallic ring and the resinous throttle body. It is usual that the metallic ring is integrally formed with the resinous main body by insert molding. Therefore, sealing the clearance or gap between the metallic ring and the resinous throttle body is very difficult.

According to a throttle apparatus disclosed in the unexamined Japanese utility model publication 4-119352, a recessed groove is formed on an outer wall of a metallic ring so that a fluid pipe of hot water can be engagedly coupled in this recessed groove. This arrangement is effective to prevent hot water from leaking through a clearance or gap between the metallic ring and the resinous throttle body. However, a substantial contact area between the recessed groove and the fluid pipe is dependent on an actual coupling condition between them. It is generally difficult to bring the fluid pipe into complete or satisfactory surface contact with the recessed groove. Thus, an actual contact area between the recessed groove and the fluid pipe is fairly small. The heat of hot water cannot be sufficiently transferred to the metallic ring.

SUMMARY OF THE INVENTION

In view of the foregoing problems of the prior art, the present invention has an object to provide a throttle body for an engine which is simple in arrangement and is capable of effectively avoiding the icing phenomenon.

Furthermore, the present invention has another object to provide a method for manufacturing an engine throttle body which is easy to manufacture and is capable of reducing the manufacturing cost.

To accomplish the above and other related objects, a first aspect of the present invention provides a first throttle body for an engine and a first manufacturing method for the engine throttle body. According to the first aspect of the present invention, an inner cylinder and an outer cylinder are formed integrally so that the outer cylinder is disposed outside the inner cylinder. A heating medium passage is formed between the inner cylinder and the outer cylinder. The heating medium passage has an annular opening at one axial end side of the throttle body. Holes extending across the wall of the outer cylinder are formed so as to communicate with the heating medium passage. The annular opening of the heating medium passage is sealed by a sealing member at the one axial end side of the throttle body. Accordingly, even when the inner cylinder and the outer cylinder are made of a resin material, it becomes possible to transfer heat of the heating medium to the entire vicinity or surrounding of the throttle valve by supplying heating medium into the heating medium passage formed outside the inner cylinder.

Hence, the first aspect of the present invention provides a simplified arrangement capable of effectively avoiding the icing phenomenon of the throttle apparatus.

Furthermore, integrally forming the inner cylinder and the outer cylinder makes it possible to simplify the assembling steps of the throttle body compared with a manufacturing method of separately forming the inner cylinder and the outer cylinder. Thus, the manufacturing cost can be reduced correspondingly.

Furthermore, the first aspect of the present invention can employ the molding operation which uses extractable dies for forming the inner cylinder and the outer cylinder so as to leave the heating medium passage therebetween. No cutting operation is required for forming the heating medium passage. Thus, the first aspect of the present invention provides a throttle body arrangement capable of reducing manufacturing steps and easy to manufacture, thereby further reducing the manufacturing cost.

Furthermore, a second aspect of the present invention provides a second throttle body for an engine and a second manufacturing method for the engine throttle body. According to the second aspect of the present invention, an inner cylinder and an outer cylinder are formed integrally so that the outer cylinder is disposed outside the inner cylinder. A heating medium passage is formed between the inner cylinder and the outer cylinder. The heating medium passage has a first annular opening at one axial end side of the throttle body and a second annular opening at the other axial end side of the throttle body. Holes extending across the wall of the outer cylinder are formed so as to communicate with the heating medium passage. The first annular opening of the heating medium passage is sealed by a first sealing member at the one axial end side of the throttle body. The second annular opening of the heating medium passage is sealed by a second sealing member at the other axial end side of the throttle body. Accordingly, even when the inner cylinder and the outer cylinder are made of a resin material, it becomes possible to transfer heat of the heating medium to the entire vicinity or surrounding of the throttle valve by supplying heating medium into the heating medium passage formed outside the inner cylinder.

Hence, the second aspect of the present invention provides a simplified arrangement capable of effectively avoiding the icing phenomenon of the throttle apparatus. Furthermore, the icing phenomenon can be further effectively prevented when the heating medium passage is formed to communicate with the inlet side of a surge tank of an engine and with the outlet side of an air cleaner of the engine.

Furthermore, integrally forming the inner cylinder and the outer cylinder makes it possible to simplify the assembling steps of the throttle body compared with a manufacturing method of separately forming the inner cylinder and the outer cylinder. Thus, the manufacturing cost can be reduced correspondingly.

Furthermore, the second aspect of the present invention can employ the molding operation which uses extractable dies for forming the inner cylinder and the outer cylinder so as to leave the heating medium passage therebetween. No cutting operation is required for forming the heating medium passage. Thus, the second aspect of the present invention provides a throttle body arrangement capable of reducing manufacturing steps and easy to manufacture, thereby further reducing the manufacturing cost.

Furthermore, a third aspect of the present invention provides a third throttle body for an engine and a third manufacturing method for the engine throttle body. According to the third aspect of the present invention, a metallic core member is formed so as to integrally form an inner cylindrical portion and an outer cylindrical portion which are coaxially arranged. A heating medium passage is formed between the inner cylindrical portion and the outer cylindrical portion. The heating medium passage has an annular opening at one axial end side of the throttle body. Holes extending across the wall of the outer cylindrical portion and the wall of a housing are formed so as to communicate with the heating medium passage. The annular opening of the heating medium passage is sealed by a sealing member at the one axial end side of the throttle body. Accordingly, the inner cylindrical portion forming part of the metallic core member is made of a metallic member. Heat of the heating medium is effectively transferred to the entire vicinity or surrounding of the throttle valve. Using a resin housing for accommodating the core member is advantageous in that the housing serves as a heat insulating member which prevents heat from radiating out of the core member. Heat of the heating medium can be effectively transferred to the entire vicinity or surrounding of the valve member. Hence, the third aspect of the present invention provides a simplified arrangement capable of effectively avoiding the icing phenomenon of the throttle apparatus.

Furthermore, integrally forming the inner cylindrical portion and the outer cylindrical portion as a core member makes it possible to simplify the assembling steps of the throttle body compared with a manufacturing method of separately forming the inner cylinder and the outer cylinder. Thus, the manufacturing cost can be reduced correspondingly.

Furthermore, the third aspect of the present invention can employ the molding operation which uses extractable dies for forming the inner cylindrical portion and the outer cylindrical portion so as to leave the heating medium passage therebetween. No cutting operation is required for forming the heating medium passage. Thus, the third aspect of the present invention provides a throttle body arrangement capable of reducing manufacturing steps and easy to manufacture, thereby further reducing the manufacturing cost.

Furthermore, according to the throttle body for an engine of the present invention and the manufacturing method for the engine throttle body of the present invention, it is preferable that hot water of a cooling water passage of the engine flows into the heating medium passage. Heat of the engine cooling water can be surely transferred to the entire vicinity or surrounding of the valve member. Hence, the present invention provides a simplified arrangement capable of effectively avoiding the icing phenomenon of the throttle apparatus.

Another object of the present invention is to provide a throttle body capable of preventing leakage of heating fluid or comparable heating medium and surely heating an annular member by this heating fluid or comparable heating medium. Furthermore, another object of the present invention is to provide a throttle apparatus incorporating this throttle body.

To accomplish the above and other related objects, the present invention provides a fourth throttle body which comprises an annular member is attached to an inside wall of a resinous or resin-made main body defining an intake passage. The annular member has a heat conductivity higher than that of the main body. The annular member has a fluid passage entirely extending in the annular member. A fluid inlet and a fluid outlet of the fluid passage are opened on an outer wall of the annular member exposed to an outside of the main body. An appropriate piping is attached to the annular member so that fluid is supplied into the fluid inlet of the annular member and discharged from the fluid outlet. Thus, the fourth throttle body effectively prevents the heating fluid from leaking through the gap or clearance between the main body and the annular member. Furthermore, the fluid flowing in the fluid passage directly heats the annular member. Thus, the heat of the fluid can be effectively transferred to the annular member.

Furthermore, the present invention provides a fifth throttle body comprising an annular member attached to an inside wall of a resinous or resin-made main body defining an intake passage. The annular member has a heat conductivity higher than that of a resinous main body. A cover member is disposed outside the annular member so as to form a fluid passage interposed between the cover member and an outer wall of the annular member. A sealing member is provided for sealing a clearance between the cover member and the outer wall of the annular member. Thus, the fifth throttle body effectively prevents the heating fluid from leaking through the gap or clearance between the main body and the annular member. Furthermore, the fluid directly heats the outer wall of the annular member. Thus, the heat of the fluid can be effectively transferred to the annular member.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF PREFERRED EMBODIMENTS

Hereinafter, a plurality of embodiments of the present invention will be explained with reference to attached drawings.

First Embodiment

A throttle body for an internal combustion engine in accordance with a first embodiment of the present invention will be explained with reference to FIGS. 1A and 1B.

Figure 1A:
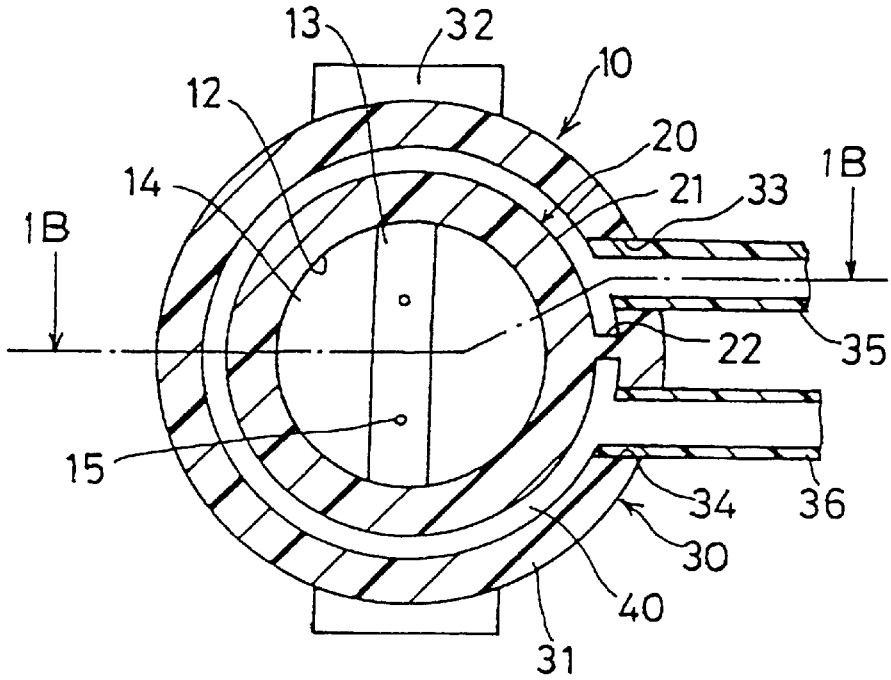
FIG. 1A is a transverse cross-sectional view showing an arrangement of a throttle body for an engine in accordance with a first embodiment of the present invention.
Figure 1B:
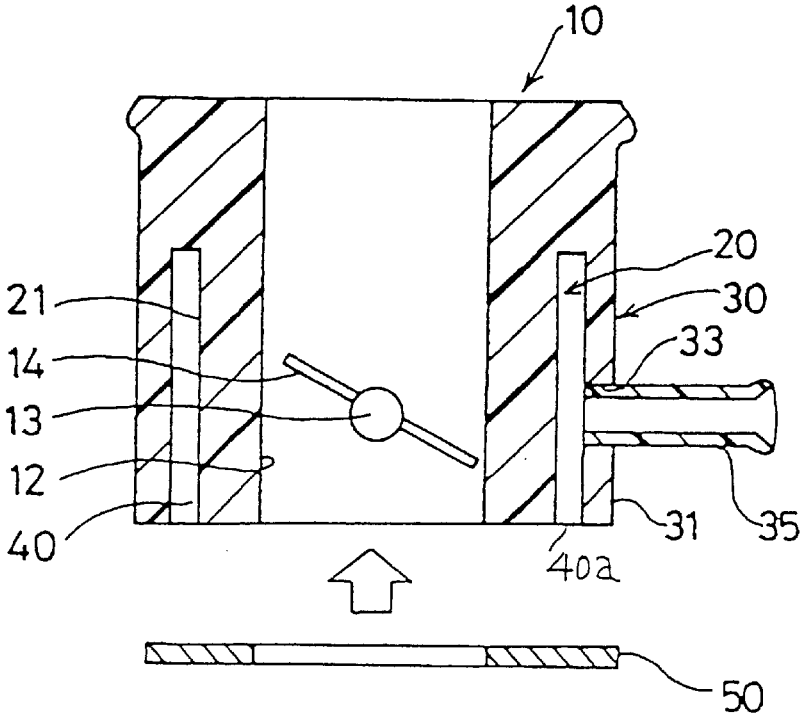
FIG. 1B is a vertical cross-sectional view showing the throttle body for an engine in accordance with the first embodiment of the present invention taken along a line 1B—1B of FIG. 1A.
Figure 2:
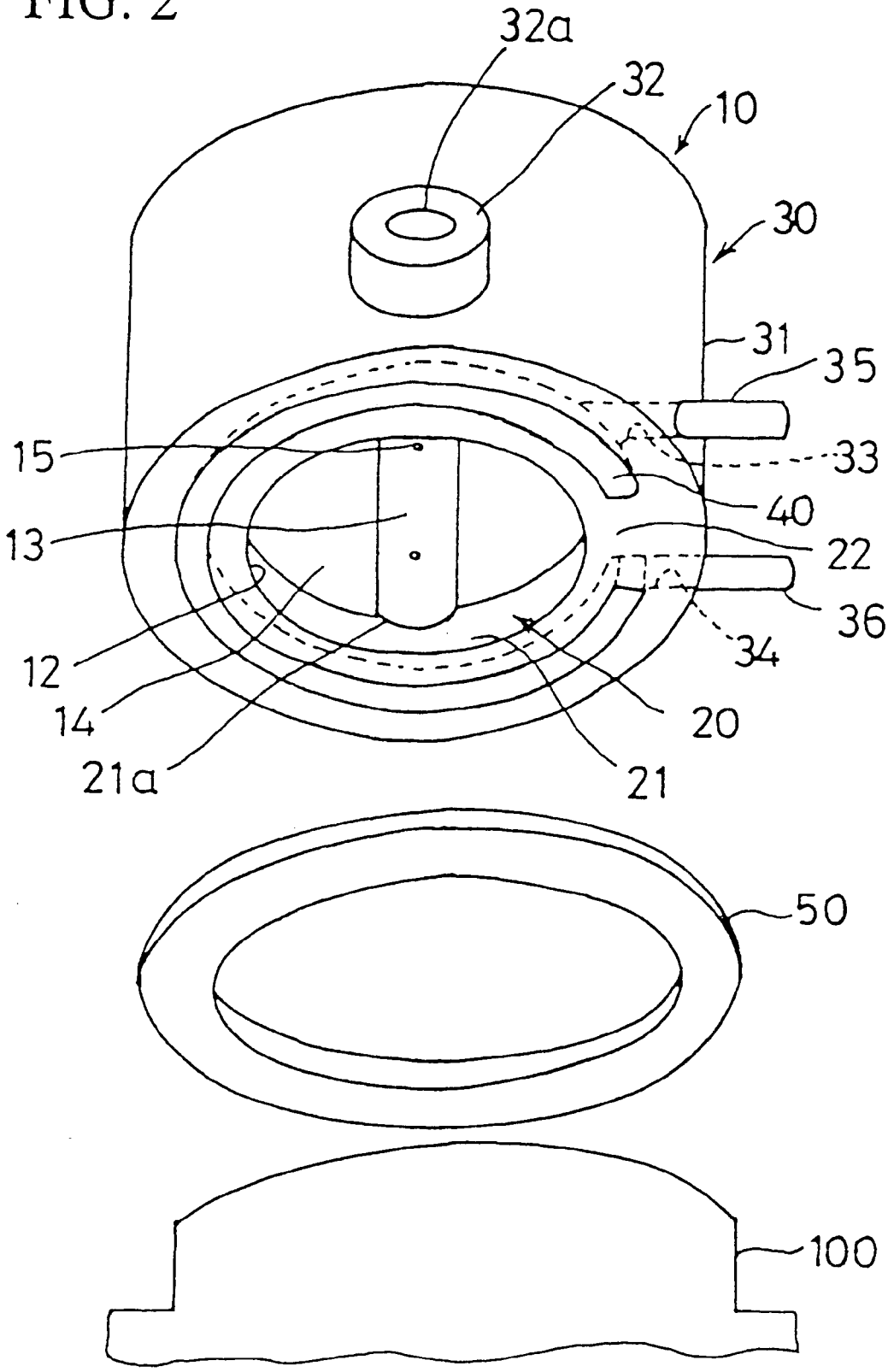
FIG. 2 is a perspective view showing a disassembled engine throttle body in accordance with the first embodiment of the present invention.

A throttle body 10 shown in FIGS. 1A and 1B is attached to an inlet opening of a surge tank 100 shown in FIG. 2. The surge tank 100 is a component constituting part of an intake system of an internal combustion engine.

The throttle body 10 is formed into a coaxial double pipe structure with an inner cylindrical housing 20 serving as an inner cylinder. A throttle valve 14 serves as a valve member. An outer cylindrical housing 30 serves as an outer cylinder disposed outside the inner cylindrical housing 20. A hot water conduit 40 serves as a heating medium passage formed between the inner cylindrical housing 20 and the outer cylindrical housing 30. Holes 33 and 34 communicate with the hot water conduit 40. And, a gasket 50 serves as a seal member closing an axial end side of the hot water conduit 40.

The inner cylindrical housing 20 and the outer cylindrical housing 30 are integrally formed by resin molding which uses shaping dies. As shown in FIG. 1B, the inner cylindrical housing 20 and the outer cylindrical housing 30 are connected at the other axial end to form a closed end side of the hot water conduit 40.

The inner cylindrical housing 20 comprises a cylindrical portion 21 forming a smooth and simple cylinder and a joint portion 22 connecting this cylindrical portion 21 to a later-described cylindrical portion 31 of the outer cylindrical housing 30. The cylindrical portion 21 has an axially extending inside space which defines an intake passage 12. The throttle valve 14, adjusting a substantial cross-sectional opening area of this intake passage, is fixed to a throttle shaft 13 by means of screws 15. The throttle shaft 13 is rotatably supported by an inside wall of the throttle body 10. More specifically, the throttle body 10 has a total of two through-holes 21*a* (refer to FIG. 2) opened at predetermined portions corresponding to later-described retaining portions 32 of the cylindrical portion 21. Both ends of the throttle shaft 13 are rotatably inserted into through-holes 21*a*. The clearance between the inner cylindrical housing 20 and the throttle valve 14 must be accurately maintained. To this end, roundness and inner diameter of the inner cylindrical housing 20 are very accurately administrated in the manufacturing process of the inner cylindrical housing 20.

The outer cylindrical housing 30, integrally formed with the inner cylindrical housing 20 and disposed outside the inner cylindrical housing 20, comprises a cylindrical portion 31 and the retaining portions 32 supporting the throttle shaft 13. The cylindrical portion 31 is connected to the cylindrical portion 21 of the inner cylindrical housing 20 via the joint portion 22. Two holes 33 and 34 are through-holes extending across the cylindrical wall of the cylindrical portion 31. An inlet pipe 35 is fixedly inserted into the hole 33 and an outlet pipe 36 is fixedly inserted into the hole 34 so that both of the inlet and outlet pipes 35 and 36 extend in the direction normal to the throttle shaft 13. The hot water conduit 40 communicates with an external device via these inlet and outlet pipes 35 and 36. The retaining portions 32, protruding in the radial direction from the outer surface of the cylindrical portion 31, have through-holes 32*a* therein as shown in FIG. 2. The through-holes 32*a* extend in the radial direction of the intake passage 12 so that both ends of the throttle shaft 13 are inserted into these through-holes 32*a*.

The hot water conduit 40 is formed between the cylindrical portion 21 of the inner cylindrical housing 20 and the cylindrical portion 31 of the outer cylindrical housing 30 through a molding process using extractable dies. As shown in FIG. 1A, when seen from the axial direction of the throttle body 10, the hot water conduit 40 has a C-shaped cross section discontinuous at the joint portion 22. The hot water conduit 40 has an annular opening 40*a* at one axial end side of the throttle body 10 so as to face an axial end side of the surge tank 100 shown in FIG. 2. The hot water conduit 40 is continuous with the holes 33 and 34 formed on the cylindrical wall of the cylindrical portion 31 which communicate with the external device. As shown in FIG. 1B, the annular opening 40*a* of the hot water conduit 40 opened at the axial end side of the throttle body 10 is sealed by a metallic gasket 50 comprising an elastic member such as rubber.

Next, a manufacturing method for the throttle body 10 will be explained.

Step 1: The inner cylindrical housing 20 and the outer cylindrical housing 30 are integrally manufactured by resin molding which uses extractable dies so as to leave the hot water conduit 40 having a C-shaped cross section between the cylindrical portion 21 of the inner cylindrical housing 20 and the cylindrical portion 31 of the outer cylindrical housing 30. The hot water conduit 40 has the annular opening 40*a* to be connected to the axial end side of the surge tank 100 and the holes opened at the cylindrical wall of the cylindrical portion 31.

Step 2: After finishing the molding, a bearing and an oil seal (both not shown) are press-fitted into each of the retaining portions 32. The throttle shaft 13 is inserted into the through-holes 21*a* and 32*a*. Then, the throttle valve 14 is fixed to the throttle shaft 13 by means of the screws 15. Then, both the inlet pipe 35 and the outlet pipe 36 are fixedly inserted into the holes 33 and 34 of the outer cylindrical housing 30.

Step 3: The annular opening 40*a* of the hot water conduit 40 is sealed by the gasket 50. The throttle body 10 is fixedly connected to the inlet side of the surge tank 100 while holding the gasket 50 interposed between the throttle body 10 and the surge tank 100. It is however possible to replace the elastic gasket 50 by a resin elastomer plate or a comparable sealing member which is thermal meltable or bondable by using an adhesive to seal the annular opening 40*a* of the hot water conduit 40. In this case, after sealing the annular opening 40*a* of the hot water conduit 40 by the resin elastomer plate or the comparable sealing member, the throttle body 10 is fixedly connected to the inlet side of the surge tank 100. Furthermore, when an appropriate sealing member is equipped beforehand at the inlet side of the surge tank 100, it is possible to directly engage the throttle body 10 with the inlet side of the surge tank 100.

Next, an operation of the throttle body 10 manufactured through the above steps 1 to 3 will be explained.

When an accelerator pedal (not shown) of an engine (not shown) is depressed, a cable (not shown) connected at one end to this accelerator shifts by an amount proportional to a depression amount of the accelerator pedal. The throttle shaft 13, connected to the other end of the cable, rotates by an amount corresponding to the shift amount of the cable. The throttle valve 14 rotates correspondingly with the same rotational angle as that of the throttle shaft 13. Intake air corresponding to the opening degree of the throttle valve 14 flows in the intake passage 12 and is introduced into a cylinder of the engine due to pumping function of a piston. Cooling water circulates in the cooling water passage connecting the radiator and the engine to cool down the engine.

After finishing the warming-up operation of the engine, part of the hot water circulating in this cooling water passage flows into the hot water conduit 40 of the throttle body 10 via the inlet pipe 35. The hot water filled in the hot water conduit 40 carries heat which is transferred via the cylindrical portion 21 of the inner cylindrical housing 20 to the entire vicinity or surrounding of the throttle valve 14. The hot water then exits from the hot water conduit 40 and returns via the output pipe 36 to the cooling water passage. Thus, even when the throttle valve 14 has frozen in a low-temperature environment, the throttle valve 14 can be surely released from the icing condition. The throttle apparatus can operate properly.

As described above, the first embodiment of the present invention forms the hot water conduit 40 between the cylindrical portion 21 of the inner cylindrical housing 20 and the cylindrical portion 31 of the outer cylindrical housing 30. The gasket 50 seals the annular opening 40*a* of the hot water conduit 40 facing to the surge tank 100. Therefore, even when the inner cylindrical housing 20 and the outer cylindrical housing 30 are made of a resin material, it becomes possible to transfer heat of the hot water to the entire vicinity or surrounding of the throttle valve 14 by supplying hot water into the hot water conduit 40 from the engine cooling water passage. Accordingly, the first embodiment of the present invention provides a simplified arrangement capable of effectively avoiding the icing phenomenon of the throttle apparatus.

Furthermore, the first embodiment of the present invention integrally forms the inner cylindrical housing 20 and the outer cylindrical housing 30. This is advantageous in that the assembling steps of the throttle body 10 can be simplified compared with a manufacturing method of separately forming the inner cylindrical housing 20 and the outer cylindrical housing 30. Thus, the first embodiment of the present invention can reduce the manufacturing cost correspondingly.

Furthermore, the first embodiment of the present invention is based on the molding which uses extractable dies for forming the inner cylindrical housing 20 and the outer cylindrical housing 30 so as to leave the hot water conduit 40 therebetween. This is advantageous in that no cutting operation is required for forming the hot water conduit 40. Thus, the first embodiment of the present invention provides a throttle body arrangement capable of reducing manufacturing steps and easy to manufacture, thereby further reducing the manufacturing cost.

Second Embodiment

Figure 3:
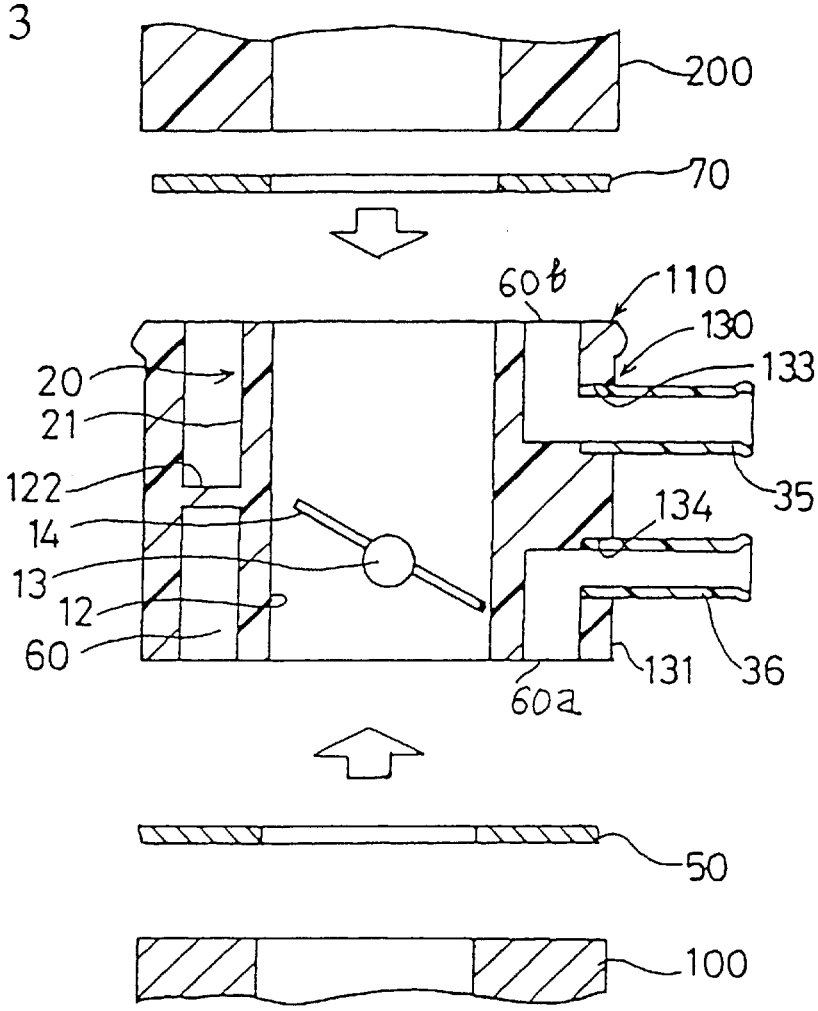
FIG. 3 is a vertical cross-sectional view showing a disassembled throttle body for an engine in accordance with a second embodiment of the present invention.

FIG. 3 shows a throttle body arrangement according to a second embodiment of the present invention. The throttle body of the second embodiment is characterized in that the hot water conduit 40 of the first embodiment shown in FIG.

1B has another annular opening formed at the opposed axial end of the throttle body. The same components as those disclosed in the first embodiment are denoted by the same reference numerals and will not be explained in this embodiment.

A throttle body 110 shown in FIG. 3 is installed between an inlet of a surge tank 100 constituting part of the engine intake system and an outlet of an air cleaner 200.

The throttle body 110 is formed into a coaxial double pipe structure with an inner cylindrical housing 20 serving as an inner cylinder. An outer cylindrical housing 130 serves as an outer cylinder disposed outside the inner cylindrical housing 20. A hot water conduit 60 serves as a heating medium passage formed between the inner cylindrical housing 20 and the outer cylindrical housing 130. Holes 133 and 134 communicate with the hot water conduit 60. And, gaskets 50 and 70 serve as first and second seal members closing both of axial end sides of the hot water conduit 60.

The inner cylindrical housing 20 and the outer cylindrical housing 130 are integrally formed by resin molding which uses shaping dies and are mutually connected at substantially the center thereof in the axial direction.

The outer cylindrical housing 130, integrally formed with the inner cylindrical housing 20 and disposed outside the inner cylindrical housing 20, comprises a cylindrical portion 131. The cylindrical portion 131 is connected to the cylindrical portion 21 of the inner cylindrical housing 20 via a joint portion 122. Two holes 133 and 134 are through-holes extending across the cylindrical wall of the cylindrical portion 131. An inlet pipe 35 is fixedly inserted into the hole 133 and an outlet pipe 36 is fixedly inserted into the hole 134 so that both of the inlet and outlet pipes 35 and 36 extend in the direction normal to the throttle shaft 13. The hot water conduit 60 communicates with an external device via these inlet and outlet pipes 35 and 36.

Figure 4:
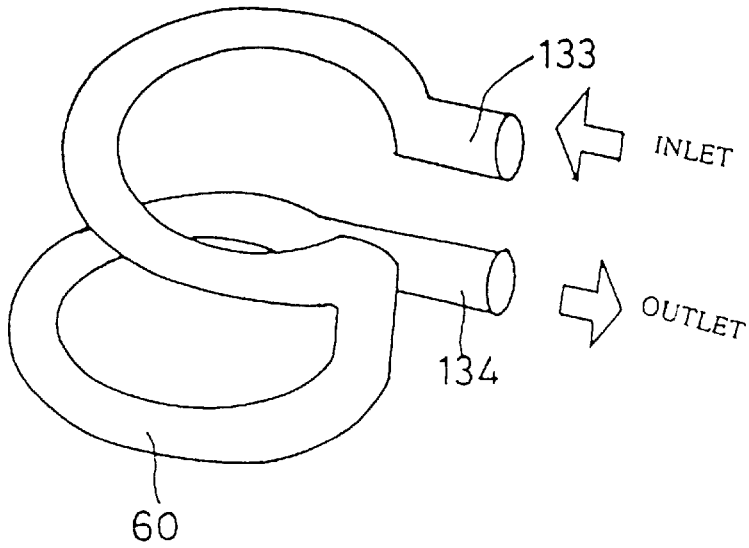
FIG. 4 is a perspective view showing an outline of a hot water conduit of the engine throttle body in accordance with the second embodiment of the present invention.

The hot water conduit 60 is formed between the cylindrical portion 21 of the inner cylindrical housing 20 and the cylindrical portion 131 of the outer cylindrical housing 130 through a molding process using extractable dies. As shown in FIG. 4, when seen from the axial direction of the throttle body 110, the hot water conduit 60 has a C-shaped cross section. The hot water conduit 60 has an annular opening 60*a* at one axial end side of the throttle body 110 so as to face an axial end side of the surge tank 100. The hot water conduit 60 is continuous with the hole 134 formed on the cylindrical wall of the cylindrical portion 131. Furthermore, the hot water conduit 60 has another annular opening 60*b* at the other axial end side so as to face an axial end side of the air cleaner 200. The hot water conduit 60 is continuous with the hole 133 extending across the cylindrical wall of the cylindrical portion 131. Both of the annular openings 60*a* and 60*b* of the hot water conduit 60 opened at the axial end sides of the throttle body 110 are sealed by gaskets 50 and 70 made of an elastic member such as rubber.

Next, a manufacturing method for the throttle body 110 will be explained.

The inner cylindrical housing 20 and the outer cylindrical housing 130 are integrally manufactured by resin molding which uses extractable dies so as to leave the hot water conduit 60 whose outline is roughly shown in FIG. 4. The hot water conduit 60 has one annular opening 60*a* to be connected to the axial end side of the surge tank 100 and the other annular opening 60*b* to be connected to the axial end side of the air cleaner 200 as well as the holes 133 and 134 opened at the cylindrical wall of the cylindrical portion 131. After finishing the molding, the throttle valve 14 is fixed to the throttle shaft 13. Then, both the inlet pipe 35 and the outlet pipe 36 are fixedly inserted into the holes 133 and 134 of the outer cylindrical housing 130.

Next, the one annular opening 60*a* of the hot water conduit 60 is sealed by the gasket 50. The throttle body 110 is fixedly connected to the inlet side of the surge tank 100 while holding the gasket 50 interposed between the throttle body 110 and the surge tank 100. Similarly, the other annular opening 60*b* of the hot water conduit 60 is sealed by the gasket 70. The throttle body 110 is fixedly connected to the outlet side of the air cleaner 200 while holding the gasket 70 interposed between the throttle body 110 and the air cleaner 200. It is however possible to replace the elastic gaskets 50 and 70 by resin elastomer plates or comparable sealing members which are thermal meltable or bondable by using an adhesive to seal the annular openings 60*a* and 60*b* of the hot water conduit 60. In this case, after sealing both of the annular openings 60*a* and 60*b* of the hot water conduit 60 by the resin elastomer plates or the comparable sealing members, the throttle body 110 is fixedly connected to the inlet side of the surge tank 100 and to the outlet side of the air cleaner 200. Furthermore, when an appropriate sealing member is equipped beforehand at the inlet side of the surge tank 100, it is possible to directly engage the throttle body 110 with the inlet side of the surge tank 100. Similarly, when an appropriate sealing member is equipped beforehand at the outlet side of the air cleaner 200, it is possible to directly engage the throttle body 110 with the outlet side of the air cleaner 200.

According to the throttle body 110 of the second embodiment, part of the hot water circulating in the cooling water passage connecting the engine and the radiator flows into the hot water conduit 60 via the inlet pipe 35. The hot water filled in the hot water conduit 60 carries heat which is transferred via the cylindrical portion 21 of the inner cylindrical housing 20 to the entire vicinity or surrounding of the throttle valve 14. The hot water then exits from the hot water conduit 60 and returns via the output pipe 36 to the cooling water passage. With this arrangement, it becomes possible to surely release the throttle valve 14 from the icing condition.

As described above, the second embodiment of the present invention forms the hot water conduit 60 between the cylindrical portion 21 of the inner cylindrical housing 20 and the cylindrical portion 131 of the outer cylindrical housing 130. The gaskets 50 and 70 seal the annular openings 60*a* and 60*b* of the hot water conduit 60 facing to the surge tank 100 and to the air cleaner 200. Therefore, even when the inner cylindrical housing 20 and the outer cylindrical housing 130 are made of a resin material, it becomes possible to transfer heat of the hot water to the entire vicinity or surrounding of the throttle valve 14 by supplying hot water into the hot water conduit 60 from the engine cooling water passage. Accordingly, the second embodiment of the present invention provides a simplified arrangement capable of effectively avoiding the icing phenomenon of the throttle apparatus.

Furthermore, the second embodiment of the present invention integrally forms the inner cylindrical housing 20 and the outer cylindrical housing 130. This is advantageous in that the assembling steps of the throttle body 110 can be simplified compared with a manufacturing method of separately forming the inner cylindrical housing 20 and the outer cylindrical housing 130. Thus, the second embodiment of the present invention can reduce the manufacturing cost correspondingly.

Furthermore, the second embodiment of the present invention is based on the molding using extractable dies for forming the inner cylindrical housing 20 and the outer cylindrical housing 130 so as to leave the hot water conduit 60 therebetween.

This is advantageous in that no cutting operation is required for forming the hot water conduit 60. Thus, the second embodiment of the present invention provides a throttle body arrangement capable of reducing manufacturing steps and easy to manufacture, thereby further reducing the manufacturing cost.

According to the above-described first and second embodiments of the present inventions, the inlet pipe 35 and the outlet pipe 36 are coupled into the holes 33 and 34 extending across the wall of the outer cylindrical housing 30 or the holes 133 and 134 extending across the wall of the outer cylindrical housing and 130. However, the inlet and outlet pipes can be integrally formed on the outer cylindrical housing when the inner cylindrical housing and the outer cylindrical housing are molded.

Third Embodiment

Figure 5A:
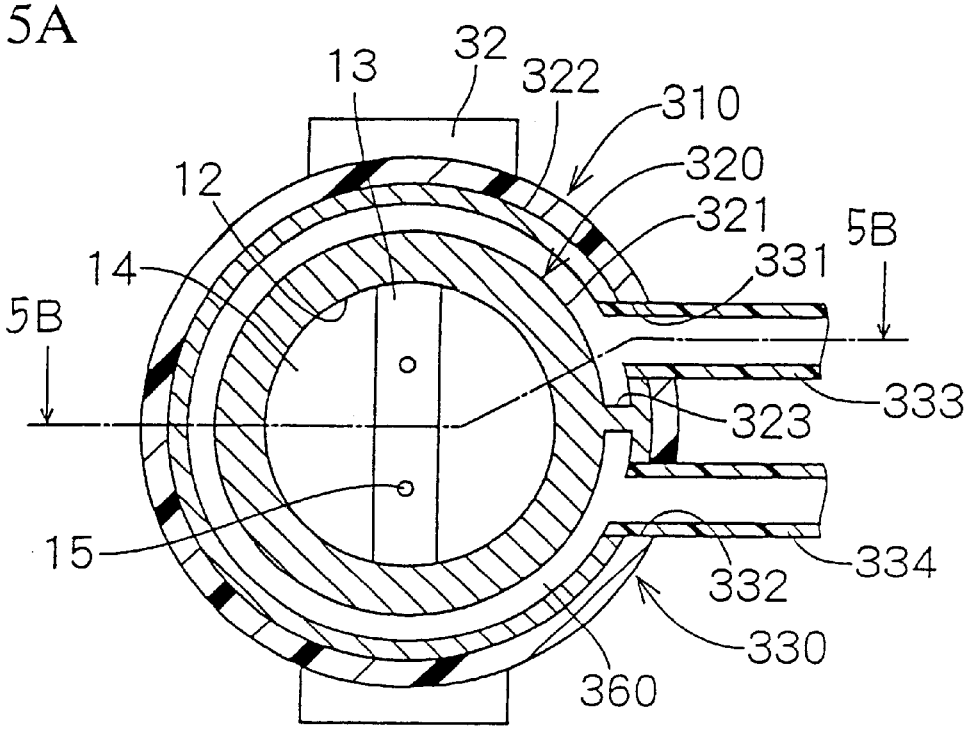
FIG. 5A is a transverse cross-sectional view showing an arrangement of a throttle body for an engine in accordance with a third embodiment of the present invention.
Figure 5B:
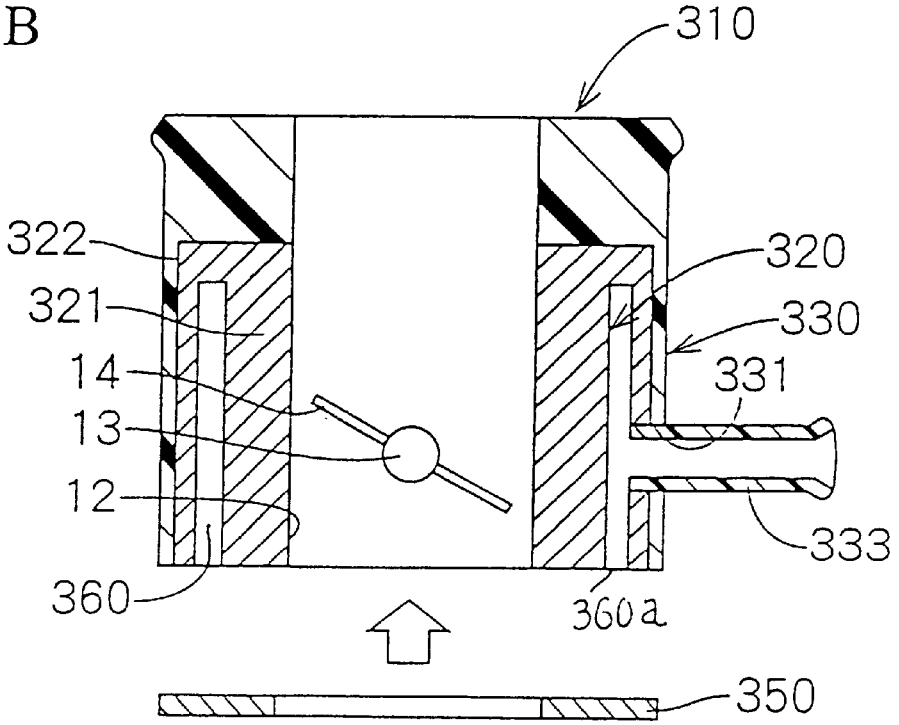
FIG. 5B is a vertical cross-sectional view showing the throttle body for an engine in accordance with the third embodiment taken along a line 5B—5B of FIG. 5A.
Figure 6:
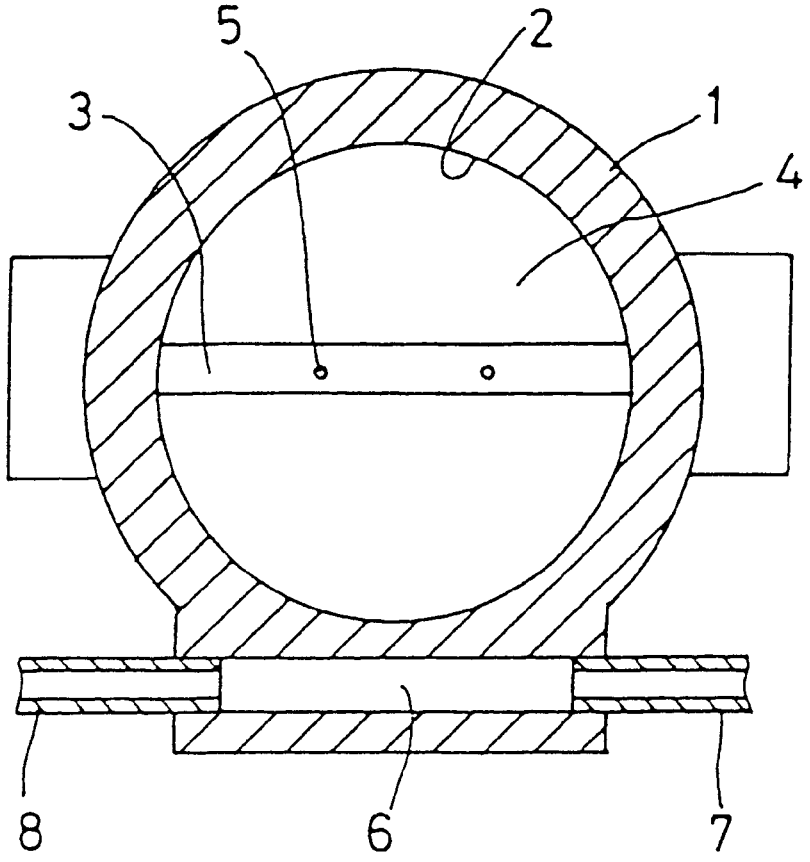
FIG. 6 PRIOR ART
FIG. 6 is a transverse cross-sectional view showing a conventional throttle body for an engine.

FIG. 5 shows a throttle body arrangement according to a third embodiment of the present invention. The throttle body of the third embodiment is characterized in the inner and outer cylinders shown in FIG. 1 are partly made of a metallic core member. The same components as those disclosed in the first embodiment are denoted by the same reference numerals and will not be explained in this embodiment.

The throttle body 310 is formed into a coaxial double pipe structure with a core member 320 and a housing 330. The core member 320 is a metallic member, for example, made of an iron or aluminum member. The core member 320 chiefly consists of an inner cylindrical portion 321 and an outer cylindrical portion 322. The inner cylindrical portion 321 and the outer cylindrical portion 322 are integrally connected via a joint portion 323. The outer cylindrical portion 322 is disposed outside the inner cylindrical portion 321. A predetermined clearance is maintained between the inner cylindrical portion 321 and the outer cylindrical portion 322.

The clearance formed between the inner cylindrical portion 321 and the outer cylindrical portion 322 is a hot water conduit 360 serving as a heating medium passage. The inner cylindrical portion 321 has an axially extending inside space which defines an intake passage 12. A throttle shaft 13 is disposed in the intake passage 12. A throttle valve 14 is fixed to the throttle shaft 13 by means of screws 15.

The housing 330, made of a resin, surrounds the outer cylindrical portion 322 of the core member 320. Thus, the housing 330 accommodates the core member 320. The throttle body 310 comprises two through-holes 331 and 332 extending across the cylindrical wall of the housing 330 and the outer cylindrical portion 322. An inlet pipe 333 is fixedly inserted into the hole 331 and an outlet pipe 334 is fixedly inserted into the hole 332 so that both of the inlet and outlet pipes 333 and 334 extend in the direction normal to the throttle shaft 13. The hot water conduit 360 communicates with an external device via these inlet and outlet pipes 333 and 334.

The hot water conduit 360 is formed between the inner cylindrical portion 321 of the core member 320 and the outer cylindrical portion 322 through a molding process using extractable dies. The hot water conduit 360 has an annular opening 360*a* at one axial end side of the throttle body 310 so as to face an axial end side of the surge tank 100 shown in FIG. 2. The hot water conduit 360 is continuous with the holes 331 and 332 extending across the walls of the outer cylindrical portion 322 and the housing 330. The annular opening 360*a* of the hot water conduit 360 opened at the axial end side of the throttle body 310 is sealed by a metallic gasket 350 comprising an elastic member such as rubber.

Next, a manufacturing method for the throttle body 310 will be explained.

The inner cylindrical portion 321 and the outer cylindrical portion 322 of the core member 320 are integrally manufactured by molding which uses extractable dies so as to leave the hot water conduit 360 having a C-shaped cross section between the inner cylindrical portion 321 and the outer cylindrical portion 322 as well as the holes 331 and 332 extending across the wall of the outer cylindrical portion 322. The molded core member 320 is assembled with the housing 330 which is formed by a resin beforehand. Thus, the housing 330 accommodates the core member 320.

The throttle shaft 13 is inserted into and supported inside the inner cylindrical portion 321. The throttle valve 14 is fixed to the throttle shaft 13. Then, both the inlet pipe 333 and the outlet pipe 334 are fixedly inserted into the holes 331 and 332 of the outer cylindrical portion 322 and the housing 330.

Next, the annular opening 360*a* of the hot water conduit 360 is sealed by the gasket 350. The throttle body 310 is fixedly connected to the inlet side of the surge tank 100 while holding the gasket 350 interposed between the throttle body 310 and the surge tank 100.

According to the above-described throttle body 310, part of the hot water circulating in the cooling water passage connecting the engine and the radiator flows into the hot water conduit 360 of the throttle body 310 via the inlet pipe 333. The hot water filled in the hot water conduit 360 carries heat which is transferred via the inner cylindrical portion 321 of the core member 320 to the entire vicinity or surrounding of the throttle valve 14. The hot water then exits from the hot water conduit 360 and returns via the output pipe 334 to the cooling water passage. Thus, it becomes possible to effectively release the throttle apparatus from the icing condition.

As described above, the third embodiment of the present invention forms the hot water conduit 360 between the inner cylindrical portion 321 and the outer cylindrical housing 322 of the metallic core member 320. The gasket 350 seals the annular opening 360*a* of the hot water conduit 360 facing to the surge tank 100. Therefore, it becomes possible to transfer heat of the hot water to the entire vicinity or surrounding of the throttle valve 14 via the metallic core member 320 having excellent heat-transfer properties by supplying hot water into the hot water conduit 360 from the engine cooling water passage. Accordingly, the third embodiment of the present invention provides a simplified arrangement capable of effectively avoiding the icing phenomenon of the throttle apparatus.

Furthermore, the third embodiment of the present invention proposes an arrangement accommodating the core member 320 in the housing 330. This is advantageous in that the assembling steps of the throttle body 310 can be simplified and the manufacturing cost can be reduced correspondingly.

Furthermore, the third embodiment of the present invention is based on the molding using extractable dies for forming the inner cylindrical portion 321 and the outer cylindrical portion 322 of the core member 320 so as to leave the hot water conduit 360 therebetween. This is advantageous in that no cutting operation is required for forming the hot water conduit 360. Thus, the third embodiment of the present invention provides a throttle body arrangement capable of reducing manufacturing steps and easy to manufacture, thereby further reducing the manufacturing cost.

Fourth Embodiment

Figure 7:
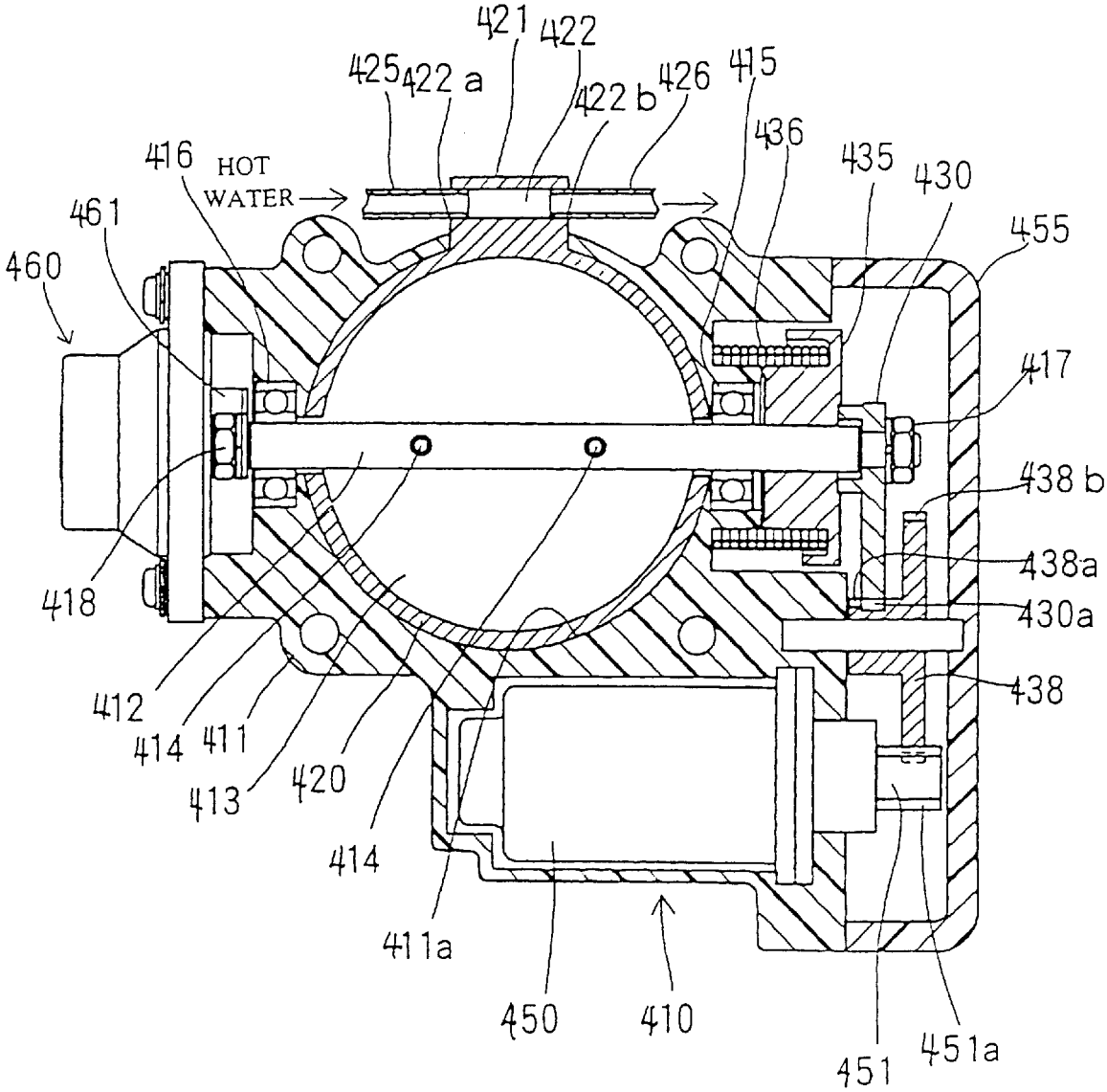
FIG. 7 is a transverse cross-sectional view showing an arrangement of a throttle apparatus in accordance with a fourth embodiment of the present invention.

FIG. 7 shows a throttle apparatus in accordance with a fourth embodiment of the present invention. A throttle opening degree of a throttle apparatus 410 is electronically controlled based on engine operating conditions, such as accelerator opening degree, engine rotational speed, engine load, cooling water temperature or the like. A main body 411 has an intake passage 411*a* formed therein. The throttle apparatus 410 adjusts an intake air amount flowing in this intake passage 411*a*. The main body 411 is an integrally formed resinous or resin-made product. FIG. 7 shows a fully closed condition of the throttle apparatus 410.

A metallic annular member 420 is attached to an inside wall of the main body 411 defining the intake passage 411*a* by insert molding. The main body 411 and the annular member 420 cooperatively constitute a throttle body. A pair of bearings 415 and 416, provided in the main body 411, are radially opposed across the intake passage 411*a*. A throttle shaft 412 has axial ends supported by the bearings 415 and 416. Thus, the throttle shaft 412 is rotatable supported by the main body 411 via the bearings 415 and 416. A valve member 413 is configured into a disk shape and is securely fixed to the throttle shaft 412 by means of screws 414. Thus, the throttle shaft 412 and the valve member 413 integrally rotate.

The annular member 420 is attached on the inner wall of the intake passage 411*a* in such a manner that the annular member 420 just surrounds the outer periphery of the valve member 13 in the fully closed condition of the throttle apparatus 410 shown in FIG. 7. The annular member 420 has a protruding portion 421 protruding in a radially outward direction from the main body 411 and exposed to an outside of the main body 411. The protruding portion 421 has a fluid passage 422 extending throughout the protruding portion 421. An inlet pipe 425 is connected to a fluid inlet 422*a* of the fluid passage 422. An outlet pipe 426 is connected to a fluid outlet 422*b* of the fluid passage 422. Hot water is introduced from the inlet pipe 425 into the fluid passage 422 and is discharged from the outlet pipe 426.

A throttle gear 430 is formed into a semicircular plate and is securely fixed to the throttle shaft 412 by means of a bolt 417. An engaging member 435 is a circular member. The engaging member 435 is coupled with the throttle gear 430 at a side opposing to the throttle gear 430 and rotates together with the throttle gear 430. A spring 436 has one end fixed to the main body 411 and the other end fixed to the engaging member 435. The spring 436 resiliently urges the throttle gear 430 and the engaging member 435 to close the valve member 413. The engaging member 435 is stopped by a full-close stopper (not shown) provided in the main body 411 when the valve member 413 is fully closed. Thus, the fullclose stopper restricts the rotation of the valve member 413 in the closing direction. The position of the full-close stopper agrees with a fully closed position in terms of the throttle opening degree. An intermediate gear 438 includes a small-diameter teethed portion 438*a* and a large-diameter teethed portion 438*b*. The small-diameter teethed portion 438*a* meshes with a teethed portion 430*a* of the throttle gear 430. The large-diameter teethed portion 438*b* meshes with a teethed portion 451*a* of a motor gear 451 of a motor 450.

The motor 450, serving as a driving means, is for example a DC motor which is installed on the main body 411. When the motor 450 rotates, rotation of the motor 450 is transmitted to the throttle shaft 412 and the valve member 413 via the intermediate gear 438 and the throttle gear 430. Thus, the throttle opening degree is adjustable in accordance with rotation of the motor 450. A cover 455 covers all of the gears and the motor 450.

A rotational angle sensor 460 is attached to the other side of the main body 411 opposed to the throttle gear 430 across the intake passage 411*a*. A sensor lever 461 is securely fixed to the throttle shaft 412 by means of a bolt 418. The sensor lever 461 rotates together with the throttle shaft 412. The rotational angle sensor 460 detects a throttle opening degree based on the rotation of the sensor lever 461.

Although not shown, the throttle opening degree detected by the rotational angle sensor 460 is sent to an engine control apparatus (hereinafter, referred to as ECU). ECU controls a current value supplied to the motor 450 based on the engine operating conditions, such as engine rotational speed, engine load, accelerator opening degree, cooling water temperature or the like, as well as based on the detection signal of the rotational angle sensor 460. The motor 450 controls the throttle opening degree in accordance with the current value determined by ECU. When the motor 450 is driven, its rotational force acts on the throttle gear 430 against the urging force of the spring 436 so that the valve member 413 rotates in the opening direction.

According to the fourth embodiment, the protruding portion 421 is integrally formed with the annular member 420 and the fluid passage 422 is formed in this protruding portion 421. Hot water is supplied into the fluid passage 422. Thus, the fourth embodiment provides an arrangement capable of effectively heating the annular member 420 with smaller number of parts. Furthermore, hot water flowing in the fluid passage 422 of the protruding portion 421 can directly heat the annular member 420. Thus, the heat of hot water can be effectively transferred to the annular member 420. Hence, the fourth embodiment surely prevents the icing phenomenon of the throttle apparatus 410.

Furthermore, the fluid inlet 422*a* and the fluid outlet 422*b* of the fluid passage 422 are opened on the protruding portion 421 serving as the outer wall of the annular member 420 exposed to the outside of the main body 411. Thus, no hot water flows in a gap or clearance between the main body 411 and the annular member 420. In other words, the fourth embodiment surely prevents hot water from leaking through the gap or clearance between the main body 411 and the annular member 420.

According to the fourth embodiment, the protruding portion 421 is formed on the integrally formed annular member 420. However, it is also possible to connect a separately provided protruding portion to an annular member surrounding the valve member 413 by welding. The fluid passage 422 can be formed so as to extend inside the annular member 420. The inlet pipe 425 and the outlet pipe 426 can be integrally formed.

Fifth Embodiment

Figure 8:
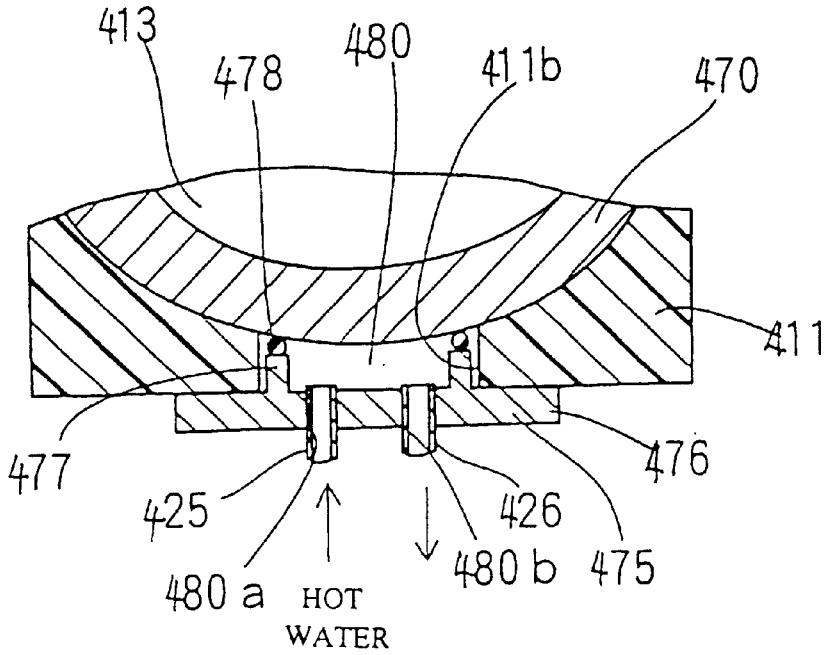
FIG. 8 is a transverse cross-sectional view partly showing a fluid passage and its vicinity of a throttle body in accordance a fifth embodiment of the present invention.

FIG. 8 shows a fifth embodiment of the present invention. The same components as those disclosed in the fourth embodiment are denoted by the same reference numerals.

A metallic annular member 470 is insert molded in a main body 411 so as to surround the outer periphery of a valve member 413. A through-hole 411*b* is opened on the main body 411 so that an outer wall of the annular member 470 is partly exposed to the outside of the main body 411. A cover member 475 comprises a plate portion 476 and a frame portion 477. The frame portion 477 serves as a passage member which protrudes in a radially inward direction through the through-hole 411*b* toward the outer wall of the annular member 470. The main body 411, the annular member 470, and the cover member 475 cooperatively constitute a throttle body. The frame portion 477 is configured into a closed rectangular shape. A rubber sealing member 478 seals the gap or clearance between the frame portion 477 and the annular member 470. Thus, the cover member 475 and the annular member 470 cooperatively define a fluid passage 480. A fluid inlet 480*a* and a fluid outlet 480*b* of the fluid passage 480 extend across the plate portion 476 and are respectively opened at the position spaced from the main body 411.

An inlet pipe 425 is connected to the fluid inlet 480*a* of the fluid passage 480. An outlet pipe 426 is connected to the fluid outlet 480*b* of the fluid passage 480. Hot water is introduced from the inlet pipe 425 into the fluid passage 480 and is discharged from the outlet pipe 426.

The sealing member 478 seals the gap or clearance between the annular member 470 and the frame portion 477 of the cover member 475. As hot water is supplied into the fluid passage 480 defined by the annular member 470 and the cover member 475, the hot water directly heats the annular member 470. Accordingly, heat of the hot water is effectively transferred to the annular member 470. Furthermore, as the fluid inlet 480*a* and the fluid outlet 480*b* of the fluid passage 480 are opened at the position spaced from the main body 411, no hot water flows in the gap or clearance between the main body 411 and the annular member 470. In other words, the fifth embodiment surely prevents hot water from leaking through the gap or clearance between the main body 411 and the annular member 470.

Sixth Embodiment

Figure 9:
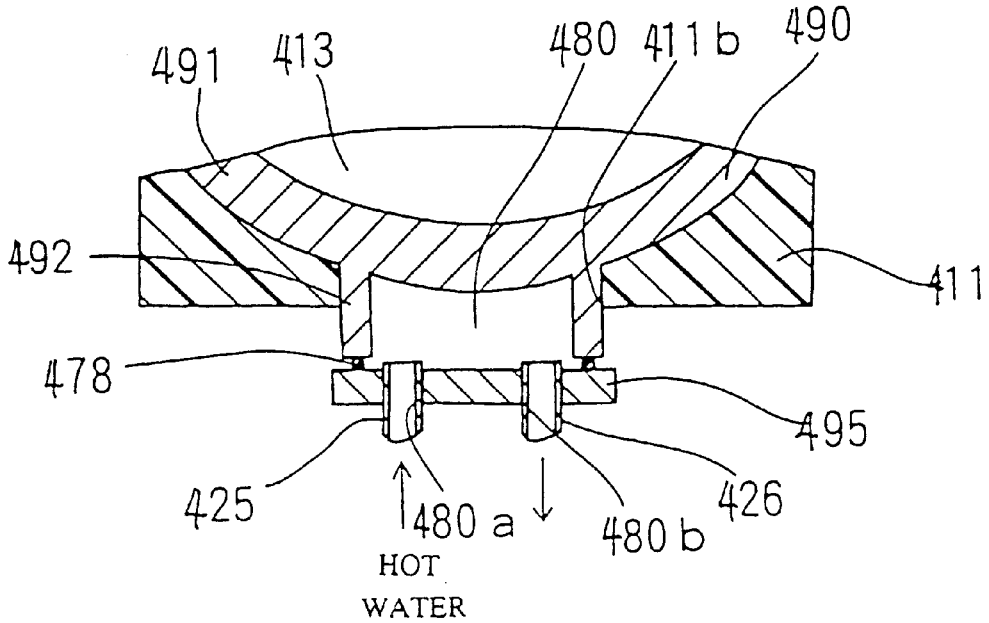
FIG. 9 is a transverse cross-sectional view partly showing a fluid passage and its vicinity of a throttle body in accordance a sixth embodiment of the present invention.

FIG. 9 shows a sixth embodiment of the present invention. Like the fifth embodiment, the same components as those disclosed in the fourth embodiment are denoted by the same reference numerals.

A metallic annular member 490 is insert molded in a main body 411 so as to surround the outer periphery of a valve member 413. The annular member 490 comprises an annular portion 491 and a frame portion 492. The frame portion 492 serves as a passage member which protrudes in a radially outward direction through a through-hole 411*b*. The main body 411, the annular member 490, and a cover member 495 cooperatively constitute a throttle body. The frame portion 492 is configured into a closed rectangular shape. A sealing member 478 seals the gap or clearance between the frame portion 492 and the cover member 495. Thus, the annular member 490 and the cover member 495 cooperatively define a fluid passage 480. A fluid inlet 480*a* and a fluid outlet 480*b* of the fluid passage 480 extend across the cover member 495 and are respectively opened at the position spaced from the main body 411.

An inlet pipe 425 is connected to the fluid inlet 480*a* of the fluid passage 480. An outlet pipe 426 is connected to the fluid outlet 480*b* of the fluid passage 480. Hot water is introduced from the inlet pipe 425 into the fluid passage 480 and is discharged from the outlet pipe 426.

The sealing member 478 seals the gap or clearance between the frame portion 492 of the annular member 490 and the cover member 495. As hot water is supplied into the fluid passage 480 defined by the annular member 490 and the cover member 495, the hot water directly heats the annular member 490. Accordingly, heat of the hot water is effectively transferred to the annular member 490. Furthermore, as the fluid inlet 480*a* and the fluid outlet 480*b* of the fluid passage 480 are opened at the position spaced from the main body 411, no hot water flows in the gap or clearance between the main body 411 and the annular member 490. In other words, the sixth embodiment surely prevents hot water from leaking through the gap or clearance between the main body 411 and the annular member 490.

According to the above-described fourth to sixth embodiments of the present invention, the annular member is made of a metallic material. However, it is possible to form the annular member by a resinous material containing metallic powers so that the resultant annular member has a heat conductivity higher than that of the resinous main body 411. Furthermore, fluid supplied into the fluid passage is not limited to hot water. For example, steam or comparable gaseous thermal energy can be used for heating the annular member.

According to the above fourth to sixth embodiments of the present invention, the valve member 413 is driven by a driving force of the motor 450. It is however possible to drive the valve member 413 by an accelerator wire.

The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A throttle body for an internal combustion engine which adjusts an air amount flowing in an air passage formed therein, comprising:

an inner cylinder having an inside space serving as said air passage therein;

a valve member provided in said inside space of said inner cylinder to control an opening degree of said air passage;

an outer cylinder formed integrally with said inner cylinder and disposed outside said inner cylinder;

a heating medium passage disposed between said inner cylinder and said outer cylinder and having an annular opening at one axial end side of said throttle body;

holes extending across a wall of said outer cylinder and communicating with said heating medium passage; and a sealing member for sealing said annular opening of said heating medium passage.

2. A throttle body for an internal combustion engine which adjusts an air amount flowing in an air passage formed therein, comprising:

an inner cylinder having an inside space serving as said air passage therein;

a valve member provided in said inside space of said inner cylinder to control an opening degree of said air passage;

an outer cylinder formed integrally with said inner cylinder and disposed outside said inner cylinder;

a heating medium passage disposed between said inner cylinder and said outer cylinder and having a first annular opening at one axial end side of said throttle body and a second annular opening at the other axial end side of said throttle body;

holes extending across a wall of said outer cylinder and communicating with said heating medium passage;

a first sealing member for sealing said first annular opening of said heating medium passage at said one axial end side of said throttle body; and a second sealing member for sealing said second annular opening of said heating medium passage at said other axial end side of said throttle body.

3. A throttle body for an internal combustion engine which adjusts an air amount flowing in an air passage formed therein, comprising:

a metallic core member having an inner cylindrical portion having an inside space serving as said air passage and an outer cylindrical portion formed integrally with said inner cylindrical portion and disposed outside said inner cylinder;

a valve member provided in said inside space of said inner cylindrical portion to control an opening degree of said air passage;

a resinous housing accommodating said metallic core member;

a heating medium passage disposed between said inner cylindrical portion and said outer cylindrical portion and having an annular opening at one axial end side of said throttle body;

holes extending across walls of said outer cylindrical portion and said housing so as to communicate with said heating medium passage; and a sealing member for sealing said annular opening of said heating medium passage.

4. The throttle body for an internal combustion engine in accordance with claim 1, wherein hot water of a cooling water passage of said engine flows into said heating medium passage.

5. A method for manufacturing a throttle body for an internal combustion engine which adjusts an air amount flowing in an air passage formed therein, comprising:

a step of integrally forming an inner cylinder and an outer cylinder, said outer cylinder being disposed outside said inner cylinder so as to leave a heating medium passage between said inner cylinder and said outer cylinder, said heating medium passage having an annular opening at one axial end side of said throttle body, and further forming holes extending across a wall of said outer cylinder and communicating with said heating medium passage; and a step of installing a valve member in an inside space of said inner cylinder and then sealing said annular opening of said heating medium passage by a sealing member at said one axial end side of said throttle body.

6. A method for manufacturing a throttle body for an internal combustion engine which adjusts an air amount flowing in an air passage formed therein, comprising:

a step of integrally forming an inner cylinder and an outer cylinder, said outer cylinder being disposed outside said inner cylinder so as to leave a heating medium passage between said inner cylinder and said outer cylinder, said heating medium passage having a first annular opening at one axial end side of said throttle body and a second annular opening at the other axial end side of said throttle body, and further forming holes extending across a wall of said outer cylinder and communicating with said heating medium passage; and a step of installing a valve member in an inside space of said inner cylinder and then sealing said first annular opening of said heating medium passage by a first sealing member at said one axial end side of said throttle body and also sealing said second annular opening of said heating medium passage by a second sealing member at said other axial end side of said throttle body.

7. A method for manufacturing a throttle body for an internal combustion engine which adjusts an air amount flowing in an air passage formed therein, comprising:

a step of forming a core member having an inner cylindrical portion and an outer cylindrical portion, said outer cylindrical portion being integral with said inner cylindrical portion and disposed outside said inner cylinder so as to leave a heating medium passage between said inner cylindrical portion and said outer cylindrical portion, said heating medium passage having an annular opening at one axial end side of said throttle body;

a step of assembling said core member with a resinous housing capable of accommodating said core member;

a step of forming holes extending across walls of said outer cylindrical portion and said housing so as to communicate with said heating medium passage; and a step of installing a valve member in an inside space of said inner cylindrical portion and then sealing said annular opening of said heating medium passage by a sealing member at said one axial end side of said throttle body.

8. The method for manufacturing a throttle body for an internal combustion engine in accordance with claim 5, wherein hot water of a cooling water passage of said engine flows into said heating medium passage.

9. A throttle body comprising:

a resinous main body having an intake passage therein; and an annular member having a heat conductivity higher than that of said main body and attached to an inside wall of said main body defining said intake passage, wherein said annular member has a fluid passage entirely extending in said annular member, and a fluid inlet and a fluid outlet of said fluid passage are opened on an outer wall of said annular member exposed to an outside of said main body.

10. A throttle body comprising:

a resinous main body having an intake passage therein;

an annular member having a heat conductivity higher than that of said main body and attached to an inside wall of said main body defining said intake passage;

wherein a cover member is disposed outside said annular member so as to form a fluid passage interposed between said cover member and an outer wall of said annular member;

a sealing member seals a clearance between said cover member and said outer wall of said annular member; and a fluid inlet and a fluid outlet of said fluid passage are opened at a portion spaced from said main body.

11. The throttle body in accordance with claim 10, wherein said annular member comprises a passage member protruding in a radially outward direction to form said fluid passage together with said cover member, and said sealing member seals a clearance between said passage member and said cover member.

12. A throttle apparatus in accordance with claim 10, wherein said cover member comprises a passage member protruding toward said annular member to form said fluid passage together with said annular member, and said sealing member seals a clearance between said annular member and said passage member.

* * * * *